US005640850A

United States Patent [19]

Benckert et al.

[11] Patent Number: 5,640,850

[45] Date of Patent: Jun. 24, 1997

[54] HYDRAULIC PRESSURE SUPPLY AND CONTROL DEVICE FOR A MOBILE CONCRETE PUMP

[75] Inventors: Hartmut Benckert; Hans Renz, both of Filderstadt; Werner Muenzenmaier, Nuertingen; Gabriel Galambos, Aichtal, all of Germany

[73] Assignee: Putzmeister-Werk Maschinenfabrik GmbH, Aichtal, Germany

[21] Appl. No.: 432,182

[22] PCT Filed: Aug. 26, 1994

[86] PCT No.: PCT/EP94/02836

§ 371 Date: May 5, 1995

§ 102(e) Date: May 5, 1995

[87] PCT Pub. No.: WO95/07399

PCT Pub. Date: Mar. 16, 1995

[30] Foreign Application Priority Data

Sep. 7, 1993 [DE] Germany ..... 43 30 137.1

[51] Int. Cl.[6] ..... F16D 31/02

[52] U.S. Cl. ..... 60/422; 60/452; 91/518; 91/532; 91/446; 137/884

[58] Field of Search ..... 60/422, 452; 91/446, 91/518, 528, 531, 532; 137/884

[56] References Cited

U.S. PATENT DOCUMENTS

| | | | |
|---|---|---|---|
| 3,766,943 | 10/1973 | Murata | 137/884 |
| 4,856,549 | 8/1989 | Ueno | 137/112 |
| 5,086,803 | 2/1992 | Nakajima | 137/884 |

FOREIGN PATENT DOCUMENTS

| | | |
|---|---|---|
| 2737884 | 3/1979 | Germany . |
| 3546336 | 7/1987 | Germany . |
| 3722479 | 3/1988 | Germany . |
| 3729216 | 3/1989 | Germany . |
| 3812753 | 10/1989 | Germany . |
| 3901207 | 7/1990 | Germany . |
| 4005967 | 8/1991 | Germany . |
| 9202227.8 | 5/1993 | Germany . |
| 4203820 | 8/1993 | Germany . |

OTHER PUBLICATIONS

"What you can get in manifolds", *Hydraulics and Pneumatics*, vol. 16, No. 11 (Nov. 1963) pp. 88–89.

Heinrich Loedige: Nutzbare Leistung Einer LS–Hydraulik O +P Olhydraulik und Pneumatik 36, 1992, Nr. 4 pp. 234, 237–241.

Albrecht Siegle: Wegeventile Mit Flanschbild Nach Din Iso 5599/1 Pneumatik Herion Informationen, 1987 pp. 66–70.

Hartmut Benckert & Hans Renz: Entwicklung der Antriebshydraulik Fuer Mobile Betonverteilermaste; O+P Olhydraulik und Pneumatik 36, 1992, Nr. 4 (pp. 242–244, 247, 248, 251).

Th. van Hamme and W. Roehrs: Entwicklungstendenzen der Hydrostatik in Baumaschinen; O+P Olhydraulik und Pneumatik 30, 1986, Nr. 7 (pp. 514–520).

*Primary Examiner*—F. Daniel Lopez

*Attorney, Agent, or Firm*—Flynn, Thiel, Boutell & Tanis P.C.

[57] ABSTRACT

A one-piece terminal block (73) is provided as a hydraulic linking element as well as a mechanical carrier for control valves (68 to 72) of a boom control unit, for an operating mode selector valve (74), and for switching elements of a pressure supply device (77). A pressure line (119), return line (132), control line (166), and a further return line (167,168) are designed as bores extending in an axial direction of the terminal block, from which connection channels originate which terminate within terminal arrays (163, 163$^{I}$ to 163$^{IV}$) in a bore layout for the valves. Sections (102') of a load feedback line (102), which are serially connectable to each other by comparative valves (114) are formed by individual longitudinal bores (188,188$^{I}$ to 188$^{IV}$) introduced into the terminal block (73) from its free end (164) and plugged there, as well as by cross-channels connecting these longitudinal bores individually to a load-comparative output (117) of one of the comparative valves as well the load-comparative input (116) of an adjacent comparative valve.

23 Claims, 7 Drawing Sheets

HYDRAULIC PRESSURE SUPPLY AND CONTROL DEVICE FOR A MOBILE CONCRETE PUMP

FIELD OF THE INVENTION

The invention is related to a hydraulic pressure supply- and control-device for a mobile concrete pump, having a multi-armed distributing boom positioned pivotably on a vehicle and having a hydraulic pivot drive and hydraulic elevation drives individually assigned to the arms of the boom, on the one hand, as well as a hydraulic support device, by which the vehicle is supported at corners of a larger area outside the vehicle base area against tipping over, on the other hand, as hydraulic consumers, for whose pressure supply a single load sensing pressure supply device is provided, whose pressure output is connectable alternatively to a hydraulic control unit of the support device or a hydraulic control unit of the distributing boom by way of an operating mode selector valve, so that—for reasons of operating safety—the support device and the boom may not be selected—"moved"—simultaneously.

BACKGROUND OF THE INVENTION

A hydraulic pressure supply- and control-device of this type was exhibited as part of a mobile concrete pump at the trade fair "BAUMA" in April 1992. In this known pressure supply-and control-device, the hydraulic control unit of the distributing boom has control valves which are individually assigned to the pivot drive and the elevation drives of the boom, electro-hydraulically or electro-pneumatically pilot controlled and hydraulically actuated, as well as pressure controlled load-comparative valves which react to the pressures prevailing in the respective partial consumers of the boom, and which are connected to each other in a hydraulic chain and mechanically combined in a control valve block, wherein the valve groups formed by one control valve and one comparative valve, respectively, each of which are assigned to one of the boom drives, are positioned spacially adjacent to each other. Herein, the comparative valves may be serially connected to each other by channels which form sections of a load feedback line. These channels lead from a comparative output of the respective comparative valve to a load-comparative terminal of that adjacent comparative valve which is positioned at the supply device side, as seen from the comparative output of the first valve. These comparative valves are moved into a functional position connecting the load connection to the comparative output and blocking it with respect to the load-comparative input by a relatively higher pressure at a load-connection, at which the pressure effective in the connected partial consumer prevails, than in their load-comparative input, and they are moved into a functional position connecting the load-comparative input to the load-comparative output and blocking this with respect to the load connection by a relatively higher pressure at the load comparative input than at the load-connection. By this, it is attained that the respectively highest pressure prevailing in one of the partial consumers is fed back to the pressure supply device, and that it may be sensed there, in order to adjust the flow rate of the pump of the pressure supply device according to the requirements. The valves combined to form the valve block have disc-shaped casings which have continuous bores in a base arranged in a defined bore layout. These bores are connected communicating each with one supply terminal or one control terminal of the respective valve. Furthermore, the valve casings have continuous bores, through which the tie rods may be stuck by which the valves may be connected to each other, such that the bores communicating with hydraulic terminals of the valves form continuous supply channels which are tightly sealed in the region of the connection planes, at which the casings of adjacent valves lie against each other, with respect to the environment, by O-rings surrounding the ports of the bores.

By this design, a hydraulic longitudinal chain of the valves combined in the block, as viewed in the direction of the casing bores aligned with respect to each other, without an appreciable expenditure of pipes, and an individual layout of the valve block with respect to the design of the mobile concrete pump and the number of moveable arms of the distributing boom, is also possible in a simple way.

A pressure supply- and control -device of this type also has a number of disadvantages, though: The numerous seals resulting from the "sandwich"-design of the valve block have, due to the unavoidable aging of the sealing rings, the consequence that leak oil may exit at the connection points of the valve block at least after some time of use, which is inacceptable even in small amounts. Therefore, the sealing rings have to be exchanged relatively often, which in practice necessitates the removal of the valve block from the vehicle, in order to remove the relatively long tie rods. The same holds for the exchange of defective valves. This maintenance is very time-consuming and expensive with respect to the maintenance and repair expenditures, as well as to the long downtime of the mobile concrete pump itself.

SUMMARY OF THE INVENTION

It is therefore the object of the invention to improve a pressure supply- and control-device of the type described above, such that it is less prone to malfunctions, and that it can be repaired in case of seal or valve damage in less time and with less expenditure.

Accordingly, a one-piece block made of steel or aluminum is provided as a hydraulic linking element as well as a mechanical carrier of the control valves of the boom control unit, of the operating mode selector valve, and possibly of switching elements of the pressure supply device, in which a P-line connected to all high pressure terminals of the control valves, a reservoir line connected to all return terminals of the control valves, at least one control line transmitting control pressure for the actuation of the valves, and at least one further return line, by which the control circuit of the pressure-actuated valves is completed to the reservoir of the pressure supply device, are designed as single-axis bores extending in a lengthwise direction of the terminal block—the direction of linking—, from which connection channels originate, whose valve-sided ports are positioned within terminal arrays of the valves in the bore layout of proportional valves.

Furthermore, the sections of the load feedback line, which are serially connectable to each other by the comparative valves, are formed by individual longitudinal bores introduced into the terminal block from its free end and plugged there, as well as by cross channels connecting these longitudinal bores individually in the load-comparative output of one of the comparative valves, as well as to the load-comparative input of the supply-sided adjacent comparative valve.

The advantages of the pressure supply- and control-device according to the invention achieved by this are, with respect to the functional dependability and ease of maintenance, the following:

1. The susceptibility to the occurrence of leaks is smaller, since the one-piece design of the terminal block, whose plugs are not subject to appreciable amounts of wear, allows avoiding a large number of seals, by which the statistical probability of damage to such seals is considerably reduced.

2. A valve or a seal between the casing of the valve and the terminal block may be exchanged, without the terminal block having to be removed from the vehicle. The time needed for performing repair or maintenance work, which is also downtime of the mobile concrete pump, is reduced to a small fraction as compared with known pressure supply- and control-devices.
3. Valves which have a simpler casing design and which are therefore less expensive may be used.
4. Since the terminal block, which is made to be supplied with proportional valves, is also suited to be supplied with simpler "black- and white-valves", the decision, by which type of valves the control is to be achieved, may be made at a relatively late instance, at which the terminal block may already be mounted on the vehicle and the pipe work may be completed, which has the advantage of a considerably more flexible product planning and process completion for the manufacturer of the mobile concrete pump.

A design of the terminal block results in a space-saving arrangement of the longitudinal bores and cross channels, which may also be realized easily with respect to the production process. In the same sense, this holds for the positioning of the load feedback line leading from the comparative valve of the operating mode selector valve to the load sensing input of the pressure supply device.

In order to utilize the assembly advantage made possible by the terminal block, it is advantageous when this, as provided in a preferred embodiment, also has a terminal array for a pressure balance or restrictor arrangement provided for the load sensing and/or a pressure limiting valve or further hydraulic switching elements for the pressure supply device.

The comparative valves assigned to the partial consumers are preferably designed as shuttle check valves which may be integrated into the control valves themselves.

In order to achieve a defined comparative pressure the comparative input of the "last" comparative valve of the comparative valves which are connected in series by the individual sections of the load feedback line, which is positioned remotely with respect to the pressure supply device, is connected with the reservoir of the pressure supply device.

By the design of the pressure supply- and control-device having proportional valves and pressure balances individually assigned to these, an especially sensitive control of the boom movements is achieved. In the embodiment of the pressure supply- and control-device having a variable displacement pump as a pressure source, the design of the flow rate control element and its control is especially useful, by which it is attained in a simple way that the output pressure of the pump is always higher by a defined amount than the highest operating pressure prevailing in one of the consumers or partial consumers.

An advantageously simple line placement for the hydraulic medium flowing from the proportional valve is given.

When the control valves for the motion control of the boom are designed as so-called "black-and-white valves" under the prerogative that the pump of the pressure supply device is a fixed displacement pump having a pressure balance as a load sensing element, it is especially advantageous when, control- and connecting-channels terminating within the terminal arrays may be covered—"plugged"—by the valve bodies.

The design of such "black-and-white-valves" is advantageous, in order to attain a sensitive boom setting and a relatively soft start of the mast during pivot movements.

By load maintaining circuits, it is ensured that the support device as well as the boom maintain a position achieved by driving also after the completion of driving.

By the type of driving of the operating mode selector valve additional safety is attained against boom movements which can result from malfunctionally caused switching positions of the boom control valves, without these actually being driven.

The drive of the operating mode selector valve into its functional positions suited for the setting operation of the support device, which are easily realized circuit-wise, this just holds for the control of the boom movements, which are realized with relatively little extra technical expenditure, but also for the control of the setting of the support device.

The electronic circuit-technical linkages necessary for this are easily realized by someone skilled in the art of electro-hydraulic control engineering and having knowledge of the purposes.

In this it may be advantageous in the sense of quick actuation of the respective boom or support device control valves, when by a first actuation of such a control valve the pre-selector stage is also correspondingly actuated.

When an actuation in the same sense of two support cylinders which are arranged at diagonally opposing corners of the support area is not possible, it is ensured circuit-wise that a tipping of the vehicle about one diagonal axis of the support area cannot be provoked by improper actuation of the support cylinders of the support device.

BRIEF DESCRIPTION OF DRAWINGS

In the following, constructive and functional details of preferred embodiments of the invention will be described further with reference to the accompanying drawing, in which.

DETAILED DESCRIPTION

Figure 1A:
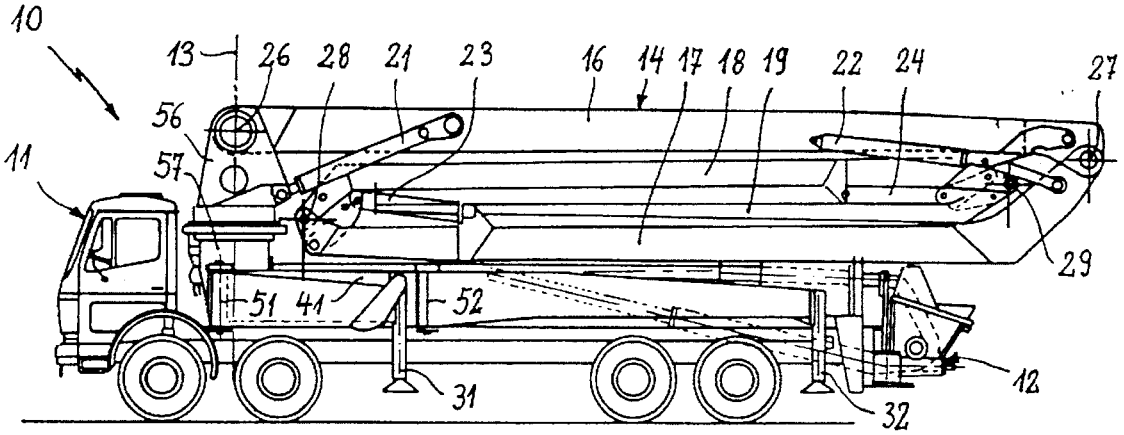
FIG. 1*a* shows a side view of a mobile concrete pump having a hydraulically actuatable distributing boom and a hydraulically actuatable support device, both in their transport configuration.
Figure 1B:
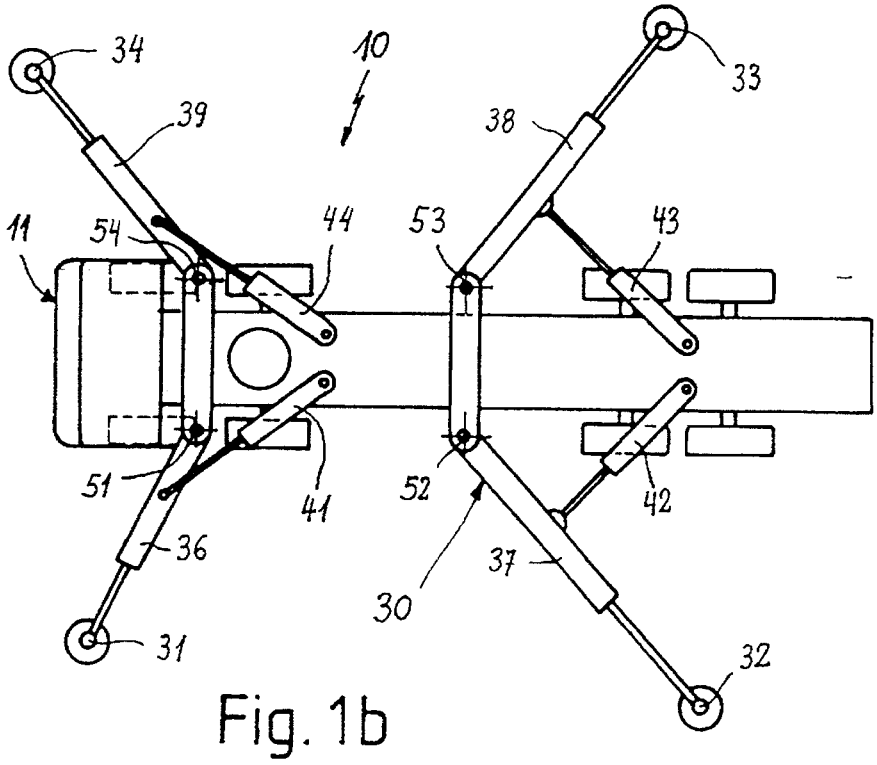
FIG. 1*b* shows the support device of the mobile concrete pump according to FIG. 1*a* in its supporting configuration in which it prevents the vehicle from tipping over.

The mobile concrete pump depicted in FIGS. 1*a* and 1*b*, generally designated by reference numeral 10, has a concrete pump 12, a distributing boom 14 pivotable about a vertical vehicle axis 13, said distributing boom 14 having a total of four pivot arms 16, 17, 18, 19 which are pivotable about horizontal pivot axes 26, 27, 28 and 29 by means of hydraulic linear cylinders 21, 22, 23 and 24. Mobile concrete pump 10 further has a support device generally designated by reference numeral 30, having four vertical hydraulic support cylinders 31 to 34 which are positioned at the free ends of horizontal extension arms 36 to 39. Extension arms 36 to 39 are pivotable about fixed vehicle vertical axes 51 to 54 from a position parallel to central chassis beams into positions shown e.g. in FIG. 1*b* in which concrete pump 10 is supported against tipping over by extending support cylinders 31 to 34 by means of horizontally acting pivot cylinders 41 to 44. Pivot column 56 of distributing boom 14, which is pivotable about vertical axes 13, also has a hydraulic pivot drive 57 which, as can be seen from the detailed depiction of FIG. 2, which is also referred to now, is realized by two double acting "parallel" hydro-cylinders 58 and 59, by means of which one rack 61 and 62, respectively, is driveable in opposing directions, said racks 61 and 62 meshing with opposing sides of a crown gear 64 which is fixed to pivot column 56.

Figure 2:
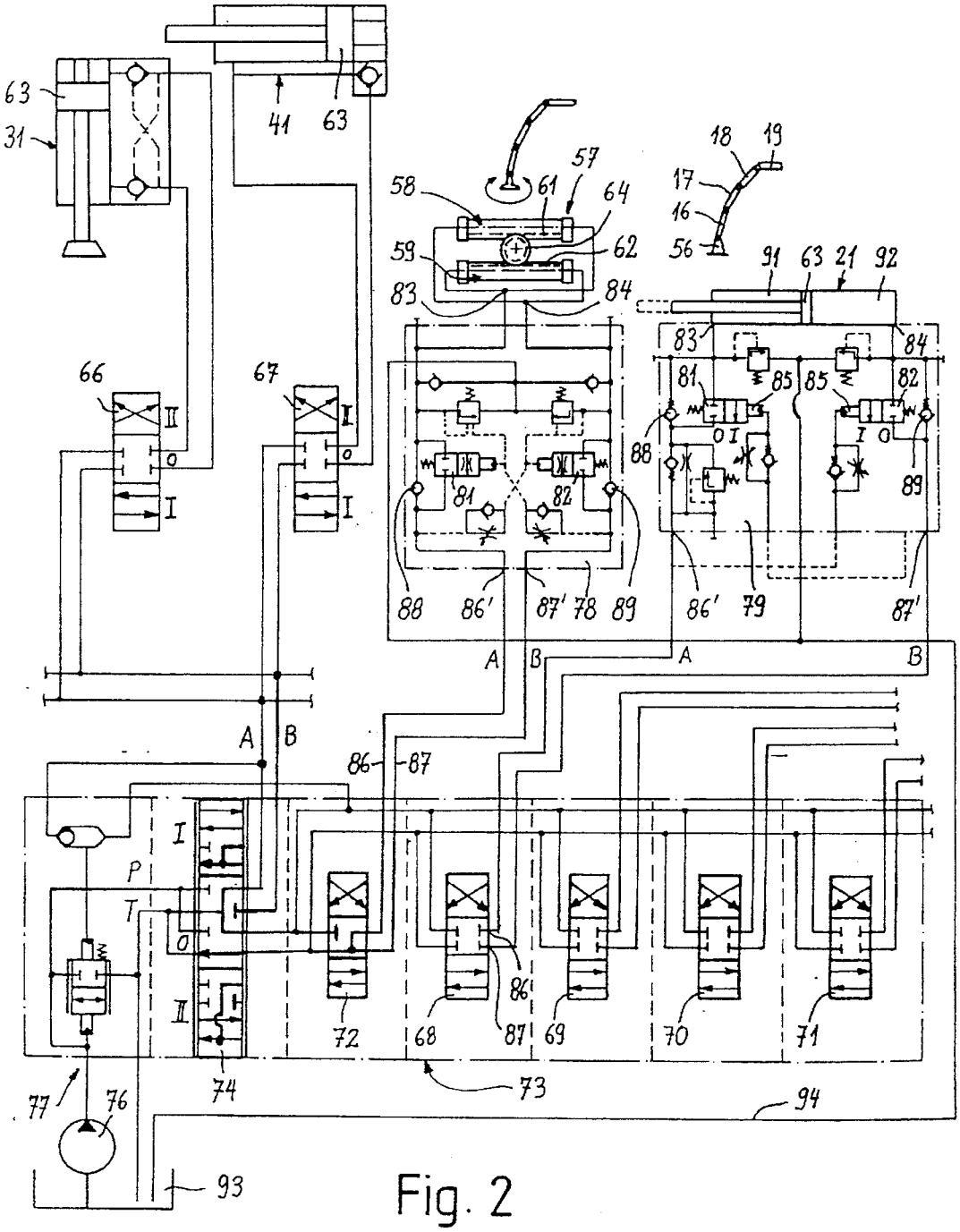
FIG. 2 shows a simplified hydraulic circuit diagram of the drive and control means of the distributing boom and the support device of the mobile concrete pump according to FIGS. 1*a* and 1*b;*

Linear cylinders 21 to 24 which are provided for elevation movements of pivot arms 16 to 19 of distributing boom 14 are fashioned as double-acting hydro-cylinders, as shown in FIG. 2 for only one of said linear cylinders, e.g. "lowermost" linear cylinder 21. Pistons 63 of said linear cylinders may be subjected to drive pressure to their total cross sectional area on their ground side and to a ring area reduced by the cross-sectional area of the piston rod at their rod side.

The correspondingly formed support cylinders 31 to 34 of support device 30 are arranged such that they are subjected to the output pressure of the working pressure source on the larger area of their piston 63 in the support mode. Double acting linear cylinders 58 and 59 of pivot drive 57 are fashioned "symmetrically" with respect to those provided for the elevation drives 21 to 24 and have piston rods extending from both sides of the cylinder casing, the ends of said pistion rods being connected to each other by means of the racks extending along the sides of the casing.

Support cylinders 31 to 34 of support device 30 and their pivot cylinders 41 to 44 for extending horizontal extension arms 36 to 39 carrying the support cylinders, only one of which is shown in FIG. 2 in order to simplify the drawing, e.g. front left support cylinder 31 and pivot cylinder 41 for its extension arm 26, are actuatable each by one support control valve 66 and pivot control valve 67, respectively, which have the basic functions of 4/3-way-valves. Said valves have two alternative flow positions I and II, which are assigned to the "forward"- and "backward"-action of the corresponding support or pivot cylinder, as well as a neutral position 0, in which piston 63 of the corresponding support or pivot cylinder rests in its momentary position.

Linear cylinders 21 to 24 provided for setting the elevation of individual pivot arms 16 to 19 and of distributing boom 14, of which FIG. 2 for simplifying purposes again shows only linear cylinder 21 coupled at one end to pivot column 56, and pivot drive 57 of distributing boom 14, said pivot drive 57 having commonly controllable linear cylinders 58 and 59, are controllable by means of a control valve 68 to 71 and 72, respectively, which is schematically shown by a 4/3-way-valve symbol. Said control valves again have two alternative flow positions I and II, which are assigned to the alternative directions of motion of pivot arms 16 to 19 and the pivot movement of distributing boom 14 as a whole, respectively, as well as a neutral position 0, in which the piston(s) of the connected elevation control cylinder or of linear cylinders 58 and 59 of pivot drive 57 remain in its/their momentary position(s).

Control valve 72 for the pivot movement of distributing boom 14 about vertical axis 13 of its pivot column 56 and elevation control valves 68 to 71 for elevation pivot drives 21 to 24 of first pivot arm 16 which is coupled to pivot column 56, of second pivot arm 17 which is coupled to first pivot arm 16, of third pivot arm 18 which is coupled to second pivot arm 17, and of fourth pivot arm 19 which is coupled to third pivot arm 18, are, in this order, mounted on a common terminal block 73 in the sense of a serial connection of these valves 68 to 72. An operating mode selector valve 74 is mounted on terminal block 73 "before" control valve 72 for the pivot movement of distributing boom 14, as seen in the direction of linking. Said valve 74 has the basic function of an 8/3-way-valve, having a neutral position 0, in which neither support device 30 nor distributing boom 14 are actuatable, and two alternative flow positions I and II, in one of which—flow position I—only support device 30 is supplied with pressure, and in the second of which—flow position II—only hydraulic drives 58 and 59 or 21 to 24, respectively, of distributing boom 14 are subjectable to drive pressure.

Operating mode selector valve 74 ensures that distributing boom 14 cannot be moved during the setting of support device 30, and that this in turn cannot be actuated when the distributing boom is moved.

Distributing boom 14 and support device 30 are two hydraulic consumers in the framework of the whole hydraulic supply-and control-device, which cannot be actuated simultaneously but only individually, thus ensuring great operating safety of mobile concrete pump 10.

This safety is further increased by technical control means not shown in the drawing by switching operating mode selector valve 74 into operating position II provided for the pressure supply of distributing boom drives 57 and 21 to 24, when at least one of control valves 68 to 72 of distributing boom 14 is actuated. This takes place simultaneously and only for the duration of the actuation.

In the same manner, switching of operating mode selector valve 74 into its operating position for the pressure supply of support cylinders 31 to 34 and pivot cylinders 41 to 44 of support device 30 is possible only when and as long as at least one of control valves 66 and/or 67 of support device 30 is/are actuated. Otherwise, the operating mode selector valve takes its neutral position 0, in which hydraulic pump 76 of the pressure supply device overall designated by reference numeral 77 is set to recirculation operating mode, or, if pump 76 is fashioned as a variable displacement pump, to maximum flow rate, during which the hydraulic medium is cooled.

In order to ensure that distributing 14 does not "fold up"—arms 16 to 19 remaining in their momentary elevation position—and that boom 14 does not turn when operating mode selector valve 74 is in its neutral position 0, hydraulic load maintaining circuits designated overall by reference numerals 78 and 79 are provided for its hydraulic linear cylinders 21 to 24 as well as for pivot drive 57 of distributing boom 14, which are provided for setting the elevation of individual pivot arms 16 to 19, said load maintaining circuits being individually allocated to set linear cylinders and having the hydraulic circuit features shown in FIG. 2, which, in order to simplify the drawing, only shows one of the load maintaining circuits 78 for the elevation cylinders, which is identically constructed for the other elevation cylinders, as well as load maintaining circuit 79 for pivot drive 57.

Load maintaining circuits 78 and 79 for the individual pivot arm drives 21 to 24 and pivot drive 57 of distributing boom 14 each comprise two pressure regulated discharge valves 81 and 82, each of which is connected inbetween the A- and B-consumer terminals 83 and 84 of the respective drive cylinder or pivot drive 57 and control valves 68 to 72 correspondingly allocated as A-terminal 86 and B-terminal 87 of linear cylinders 21 to 24 and pivot drive 57 of distributing boom 14. These discharge valves 81 and 82 are fashioned as 2/2-valves with a spring-centered, locking neutral position 0, which may be switched into a throughput setting I by subjecting their control chambers 85 to pressure. One input check valve 88 and 89 each is switched in parallel to discharge valves 81 and 82. Each check valve is subjected in its opening direction by a relatively higher pressure at the corresponding A- or B-output of the corresponding control valve than in the connected pressure space, e.g. pressure space 91 on the rod side and pressure space 92 at the bottom side of linear cylinders 21 to 24, and which is otherwise blocked. Control chamber 85 of discharge valve 81 preceding A-consumer terminal 83 is connected to the B-input 87' of load maintaining circuit 78 or 79, which in turn is connected to B-terminal 87 of the corresponding control valve, and in the same manner control chamber 85 of discharge valve 82 preceding B-consumer terminal 84 to A-input 86' of load maintaining circuit 78 or 79. Load maintaining circuit 78 and 79 are directly mounted at linear cylinders 21 to 24 and pivot drive 57, while the corresponding control valves 68 to 72 are mounted at the remotely positioned terminal block 73. By this design of load maintaining circuits 78 and 79, the discharge valve of the other pressure space 92 or 91 is opened by action of the pressure which is present in that pressure space 91 or 92 into which the hydraulic fluid is forced, so that hydraulic fluid may flow from this pressure space.

Hydraulic locks functionally corresponding to load maintaining circuits 78 and 79 are advantageously provided also for the support cylinders and the pivot cylinders of support device 30 and are shown in FIG. 2 as pilot controlled check valves.

Differences between load maintaining circuit 78 of elevation drives 21 to 24 of distributing boom 14 and load maintaining circuit 79 of its pivot drive 57 are present insofar as pressure delimiting valves connected inbetween A- and B-consumer terminals 83 and 84 and a return line 94 leading back to the reservoir 93 of pressure supply device 77 are designed for the same maximum pressure value for the pivot drive, to different values, though, for linear cylinders 21 to 24 used as elevation drives, in which the higher value is set for bottom pressure space 92 of linear cylinders 21 to 24, which is subjected to the high output pressure of pressure supply device 77 during the raising of distributing boom 14. Correspondingly, a further pressure limiter is provided for elevation drive cylinders 21 to 24, which limits the pressure supplied to pressure space 91 at the rod side to a lower value than the maximum value of the output pressure of hydraulic pump 76.

Figure 3:
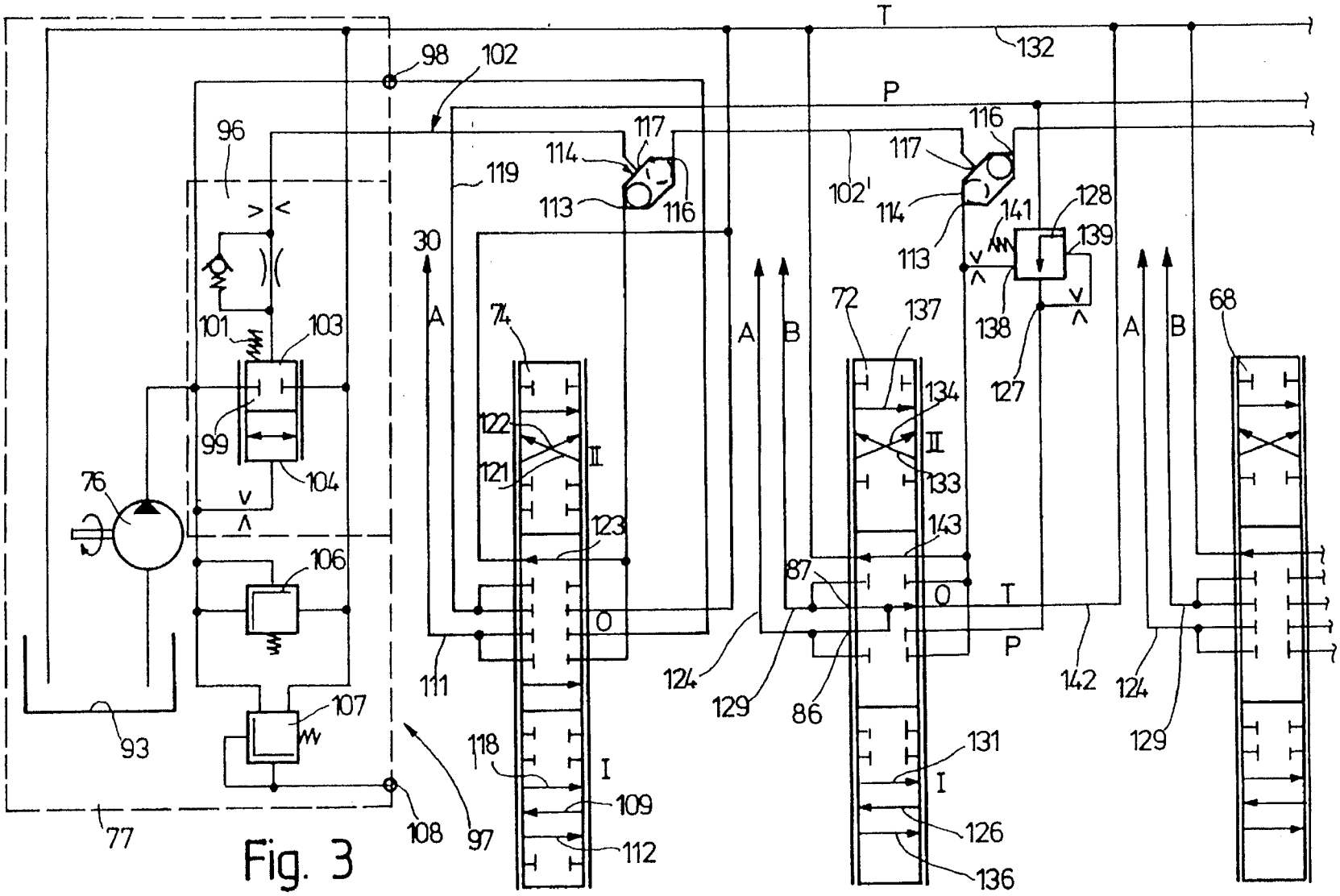
FIG. 3 shows a hydraulic circuit diagram for describing a first embodiment of a pressure supply- and control-device having a fixed displacement pump and proportional valves provided for controlling the movement of the boom.

For a more detailed description of a pressure supply- and control-device (overall designated by reference numeral 97) comprising hydraulic pump 76, pressure regulating means (overall designated by reference numeral 96), operating mode selecting valve 74, and control valves 68 to 72, it is now referred to FIG. 3.

For the pressure supply- and control-device 97 shown in FIG. 3, it is presumed that hydraulic pump 76 provided as the primary pressure source is fashioned as a fixed displacement pump, which may be operated with a time-constant supply amount Q and which operates within the frame of pressure supply device 77 comprising pressure regulating means 96 as a load sensitive pump, in that the high supply pressure provided at pressure output 98 of pressure supply device 77 varies with the load by the corresponding hydraulic consumers—support device 30 or distributing boom 14.

The corresponding control is provided by a 3-way pressure balance 99 connected inbetween pressure output 98 and reservoir 93 of pressure supply device 77, which is designed as a pressure regulated 2/2-way proportional valve which is subjected to a pre-stressed valve spring 101 as well as to the pressure falling off at the connected consumer, which acts at a load feedback line of pressure balance 99 (overall designated by reference numeral 102) in the sense of enlarging the flow resistance of the setting choke formed by pressure balance 99, and is subjected to the pressure at pressure output 98 of pressure supply device 77, which acts on the opposed face 104 of the piston of pressure balance 99 in the sense of decreasing the flow resistance through the choke formed by pressure balance 99.

The pressure acting on the one face 103 of pressure balance 99 through load feedback line 102 corresponds to the respective highest pressure falling off over one of these partial consumers respectively represented by its control valve, when a number of drives 21 to 24 and/or 57 of distributing boom 14 are actuated at the same time.

Pressure supply device 77 further comprises a pressure limiting valve 106 that limits the pressure at high pressure output 98 to a maximum value of e.g. 400 bar, as well as a pressure reducing valve 107 which supplies a—relatively low—pressure of approximately 25 bar at a control pressure output 108 of pressure supply device 77 as a control pressure for control valves 68 to 72 as well as for operating mode selector valve 74.

Operating mode selector valve 74 which is positioned immediately downstream of pressure supply device 77 in the sense of a serial connection, control valve 72 for pivot drive 57 of distributing boom 14 following in this serial connection, and control valves 68 to 71 individually assigned to the individual pivot arm drives 21 to 24, of which FIG. 3, in order to simplify the drawing, only shows the "first" control valve 68 assigned to linear cylinder 21 which is coupled at one side to pivot column 56 of distributing boom 14, to which the further control valves 69 to 71 are identical, are fashioned as proportional valves which enable continuous changes of the flow cross sections of the respectively opened flow paths within their different flow positions I and II attainable from neutral positions 0 and assigned to alternative functional states and thus a sensitive control of the individual drives.

In the functional position I of operating mode selector valve 74 enabling the pressure supply of support device 30, pressure output 98 of pressure supply device 77 is connected by way of a first flow path 109 of operating mode selector valve 74 to a high pressure supply line 111 leading to support device 30. High pressure line 111 is connected by way of a second flow path 112, which is also opened in functional position I, to a load connection 113 of a comparative valve 114 depicted as an alternating check valve which is thereby set into a functional position in which high pressure supply line 111 of support device 30 is connected to load feedback line 102 leading to the one face 103 of the piston of pressure balance 99 of pressure supply device 77. Load feedback line 102 is shut off with respect to a section 102' of the load feedback line leading back to pressure balance 99, said section 102' being connected to a load comparative terminal 116 of comparative valve 114. Section 102' originates from comparative output 117 of a comparative valve 114 of analogous design and function, which is assigned to control valve 72 for pivot drive 57 of distributing boom 14.

In the functional position I of operating mode selector valve 74, assigned to the high pressure supply of support device 30, a high pressure supply line 119, which originates from operating mode selector valve 74 and is provided for the pivot arm drives 57 and 21 to 24, is connected to reservoir 93 of pressure supply device 77 by way of a flow path 118, which is further opened in this functional position I, so that the distributing boom drives cannot be activated.

In the functional position II of the operating mode selector valve, assigned to the setting of distributing boom 14, pressure output 98 of pressure supply device 77 is connected to high pressure supply line 119 for the boom drives by way of a first flow path 121, which is opened in this function position II, while high pressure supply line 111 provided for support device 30 is connected to reservoir 93 by way of a second flow path 122 opened in functional position II, and is therefore without pressure, so that support device 30 cannot be actuated in the functional position II of operating mode selector valve 74.

In the—spring centred—neutral position 0 of operating mode selector valve 74 only a flow path 123, by which load connection 113 of comparative valve 114, which is assigned to operating mode selector valve 74, is connected to reservoir 93 of pressure supply device 77, so that this comparative valve 114 moves into that possible functional position in which load connection 113 is blocked and load feedback line section 102' is connected to load feedback line 102 leading to pressure balance 99, when pressure reaches load comparative terminal 116 by way of load feedback line section 102'.

Control valve 72, assigned to pivot drive 57 of distributing boom 14, has a functional position I which is assigned to pivoting the distributing boom counter-clockwise and a functional position II which is assigned to pivoting the distributing boom clockwise. In the neutral position 0 of this control valve 72, pivot drive 57 of distributing boom 14 is held in its respective azimuthal position by way of its load maintaining circuit 79.

In the functional position I supply line 124, which leads from A-terminal 86 on the valve side to A-input 86' of pivot drive 57 on the consumer side, is connected to pressure output 127 of a 2-way pressure balance 128, which is connected inbetween control valve 72 and pressure output 98 of pressure supply device 77, by way of a first flow path 126 which is opened in this functional position I. The second supply line 129, leading from B-terminal 87 of control valve 72 to B-input 87' of pivot drive 57 at the consumer side, is connected to return line 132 leading back to reservoir 93 of pressure supply device 77 by way of a second flow path 131 which is opened in functional position I of control valve 72.

In functional position II of pivot drive control valve 72 supply line 129, leading from B-terminal 87 of control valve 72 to B-input 87', is connected "in reverse" to high pressure output 127 of pressure balance 128 by way of a first flowpath 133 opened in this functional position II. The other supply line 124, leading from A-terminal 86 of control valve 72 to A-input 86', is connected to the pressureless reservoir 93 of pressure supply device 77 by way of a second flow path 134.

In both functional position I and II of pivot drive control valve 72 third flow paths 136 and 137 are opened, by way of which the pressure at the consumer side is on the one hand present at load connection 113 of comparative valve 114 assigned to pivot drive 157 and on the other hand also at comparative input 138 of pressure balance 128 which is hydraulically connected in series with pivot drive control valve 72, reference input 139 of pressure balance 128 being connected to its pressure output 127. This pressure balance 128, which again is designed as a choke having a variable flow resistance and which is subjected to the force of a prestressed valve spring 141 and the force acting in the same direction, which results in the load pressure at comparative input 138, in the sense of decreasing its flow resistence, and which is subjected to its output pressure also present at its reference input 139 in the sense of enlarging its flow resistance, has the effect that different flow cross sections of flow paths 126 and 131 or 131 and 134 may correspond to functional positions I and II of pivot drive control valve 72, depending on how fast the pivoting of the boom is to take place, in which the pressure drop across pivot drive control valve 72 remains constant in functional positions I and II.

In the neutral position 0 of pivot drive control valve 72, its A-terminal 86 and its B-terminal 87 are connected to return line 132 and therefore to pressureless reservoir 93 of pressure supply device 77 by way of a common discharge line 142. Further, load connection 113 of comparative valve 114, assigned to pivot drive control valve 72, and comparative input 138 of pressure balance 128, assigned to pivot drive 57, are connected to return line 132 and reservoir 93, respectively, by way of a flow path 143 additionally opened in this neutral position 0.

Pressure output 127 of this pressure balance 128 is blocked with respect to the partial consumer—pivot drive 57—connected to pivot drive control valve 72 in the neutral position 0 of pivot drive control valve 72.

Elevation control valves 68 to 71, assigned to the further "partial" consumers of distributing boom 14—linear drive cylinders 21 to 24 provided as drives for pivot arms 16 to 19—, are incorporated into the interlink system of the pressure supply- and control-device 97 together with one comparative valve 114 each and a pressure balance 128 in the same manner as described for pivot drive control valve 72, to which may be taken reference insofar. For elevation control valves 68 to 71 the difference with respect to the pivot drive control valve 72 is only that in their neutral position 0 the supply lines 124 and 129 coming from the respective control valve are also blocked with respect to reservoir 93 of pressure supply device 77, so that these supply lines 124 and 129 always remain filled with the hydraulic fluid medium.

By way of the comparative valves 114, whose load comparative terminal 116 is respectively connected to the comparative output 117 of the comparative valve following downstream in the chain, in which comparative output 117 of the "first" comparative valve 114, as designed to operating mode selector valve 74, is connected to the one face 103 of the piston of pressure balance 99 of pressure supply device 77 and load comparative terminal 116 of the "last" elevation control valve 71, which is positioned remote from operating mode selector valve 74 on terminal block 73, is connected to reservoir 93, it is accomplished that the respective highest value of pressure acting on the pressure balance 99 is reported back by way of load feedback line 102, with which one of the partial consumers of distributing boom 14 is operated, since the comparative valve 114 of the corresponding control valve is brought into the functional position in which its load comparative terminal 116 is blocked with respect to the next comparative valve and the consumer operating pressure holds comparative valves 114, positioned inbetween "its" comparative valve and pressure balance 99, in their functional position in which load comparative input 116 is opened and their load connection 113 is blocked with respect to the partial consumer, by this operating pressure. As a result, it is accomplished that pressure supply device 77—controlled by pressure balance 99—always produces an output high pressure corresponding to the requirements.

Operating mode selector valve 74 and control valves 68 to 72 of pressure supply- and control-device 97, provided for the drive control, are designed as hydraulically actuated proportional valves with a spring-centred neutral position 0, in which the control pressure, to which the respective displacements of their slides with respect to the neutral position and therefore the flow cross sections of the respectively opened flow paths are proportional, can be set by electro-hydraulic or electro-pneumatic, under circumstances also hand-actuatable in the sense of an emergency actuation, pilot valves (not shown).

In the further embodiment of a pressure supply- and control-device 97' of a mobile concrete pump 10, shown in FIG. 4, to which reference is now taken, its operating mode selector valve 74 and the control valves 68 to 72 also have the design and function described with reference to FIG. 3, and are in the same manner mounted interlinked on a common terminal block including comparative valves 114 and pressure balances 128 individually assigned to them. The hydraulic circuit elements of pump 76' are also arranged on this common terminal block, i.e. pressure limiting valve 106, pressure reducing valve 107 and a 2/2-way-valve 154 which is "located" in the same way as pressure balance 99 of pressure supply- and control-device 97 according to FIG. 3, which fulfills a different function within the frame of device 97' according to FIG. 4, though.

Further differing from the embodiment of FIG. 3, pump 76' of pressure supply device 77' is designed as a variable displacement pump whose output volume flow may be controlled according to the requirements. A suitable pump of this type is e.g. a pivot-disc-pump whose pivot disc, schematically shown in FIG. 4 by arrow 146, is forced into a position corresponding to a maximum flow rate of pump 76' of pressure supply device 77' by way of a prestressed spring 147, as long as no further forces act on pivot disc 146.

The piston rod 148 of a pivot cylinder 149 designed as a double acting linear cylinder is coupled to pivot disc 146. The drive-pressure space 151 at the bottom side of pivot cylinder 149 is subjected to the output pressure from pressure output 98 of hydraulic pump 76', and the drive-pressure space 155 on the rod side of pivot cylinder 149 is connected to load feedback line 102 of pressure supply- and control-device 97', which originates at comparative output 117 of comparative valve 114, assigned to operating mode selector valve 74.

2/2-way-valve 154 is connected in parallel with hydraulic pump 76' inbetween pressure output 98 of pump 76' and reservoir 93, and is forced into its blocking neutral position 0 by a pre-stressed valve spring 156.

To pressure output 98 of hydraulic pump 76' a relief flow path 152 is connected by way of a choke 150, which is connected to reservoir 93 of pressure supply device 77' only in the neutral position 0 of operating mode selector valve 74 by way of a flowpath 153 opened in this neutral position, which is blocked, though, in functional positions I and II of the operating mode selector valve, so that in these functional positions I and II a high pressure may build up in the relief flow path, with which the piston of valve 154 is subjected at its spring side, and thus subjected to a further force in the same direction as the restoring force of spring 156, and urges the 2/2-way-valve into its locking position. On face 157 of the piston of the 2/2-way-valve opposing the spring side, the piston is subjected to the output pressure of pump 76' and therefore a force proportional thereto, which forces the 2/2-way-valve into its flow position I and also holds it in this flow position I—against the restoring force of spring 156—when relief flow path 152 is pressure-relieved by way of operating mode selector valve 74.

Valve spring 156 of the 2/2-way-valve which may have a design corresponding to pressure balance 99 of the embodiment according to FIG. 3, is designed such that valve 154 achieves its flow position I by way of a relatively low control pressure—excess pressure on face 157 of its piston opposing the spring—of e.g. 10 bar.

Spring 147, by which pivot disc 146 of hydraulic pump 76' is brought into a position corresponding to a maximum flow rate of hydraulic pump 76', is designed such that it holds pivot disc 146 in this position as long as the difference of pressures between the bottom drive-pressure space 151 and the rod-sided drive-pressure space 155 of pivot cylinder 149 is smaller than a threshold value of approximately 20 bar.

Pressure supply- and control-device 97' described insofar concerning its design differences with respect to pressure supply- and control-device 97 according to FIG. 3 functions as follows:

As long as a consumer is not connected to pressure output 98 of pressure supply device 77', e.g. the operating mode selector valve is in its neutral position 0, hydraulic pump 76' operates in circulation mode, since 2/2-way-valve 154 attains its flow position I by way of the pressure building up at its input 158, the pressure acting on piston face 157 opposing the spring side of the valve piston. Thereby pressure medium may flow to reservoir 93 by way of 2/2-way-valve 154. The pressure falling off over 2/2-way-valve 154 has a value in circulation mode of pump 76' of approximately 10 bar, which is equivalent to the restoring force of valve spring 156. This pressure, which is also applied to bottom drive-pressure space 151 of pivot cylinder 149, is not sufficient to actuate pivot cylinder 149 against the restoring force of spring 147 "acting in opposite direction" and to turn pivot disc 146 which is thereby held by spring 147 in the position corresponding to the maximum flow rate of hydraulic pump 76'. The hydraulic fluid, having a large flow volume, is constantly recirculated in the circulation mode as long as a consumerboom 14 or support device 30—is not actuated, and may thereby be cooled efficiently.

When a consumer is connected by actuation of operating mode selector valve 74, the pressure at pressure output 98 of pressure supply device 77' increases, since now operating mode selector valve 74 blocks relief flowpath 152 against reservoir 93, since the pressure medium cannot flow off by way of 2/2-way-valve 154. By the output pressure of hydraulic pump 76', which acts on bottom drive-pressure space 151 of pivot cylinder 149, its pivot disc 146 may be pivoted in the sense of decreasing the flow rate of hydraulic pump 76'. Countering the corresponding adjusting force and in the same direction as the force of the prestressed spring 147, a force acts which results by subjecting to pressure the rod-sided drive-pressure space 155 of pivot cylinder 149 with the pressure added to this drive-pressure space 155 by way of load feedback line 102.

The result of this control of pivot cylinder 159 is that the output pressure produced by hydraulic pump 76' under load always exceeds the pressure used by the consumer by an amount which is equivalent to the restoring force of spring 147, in the present embodiment by 20 bar.

Figure 4:
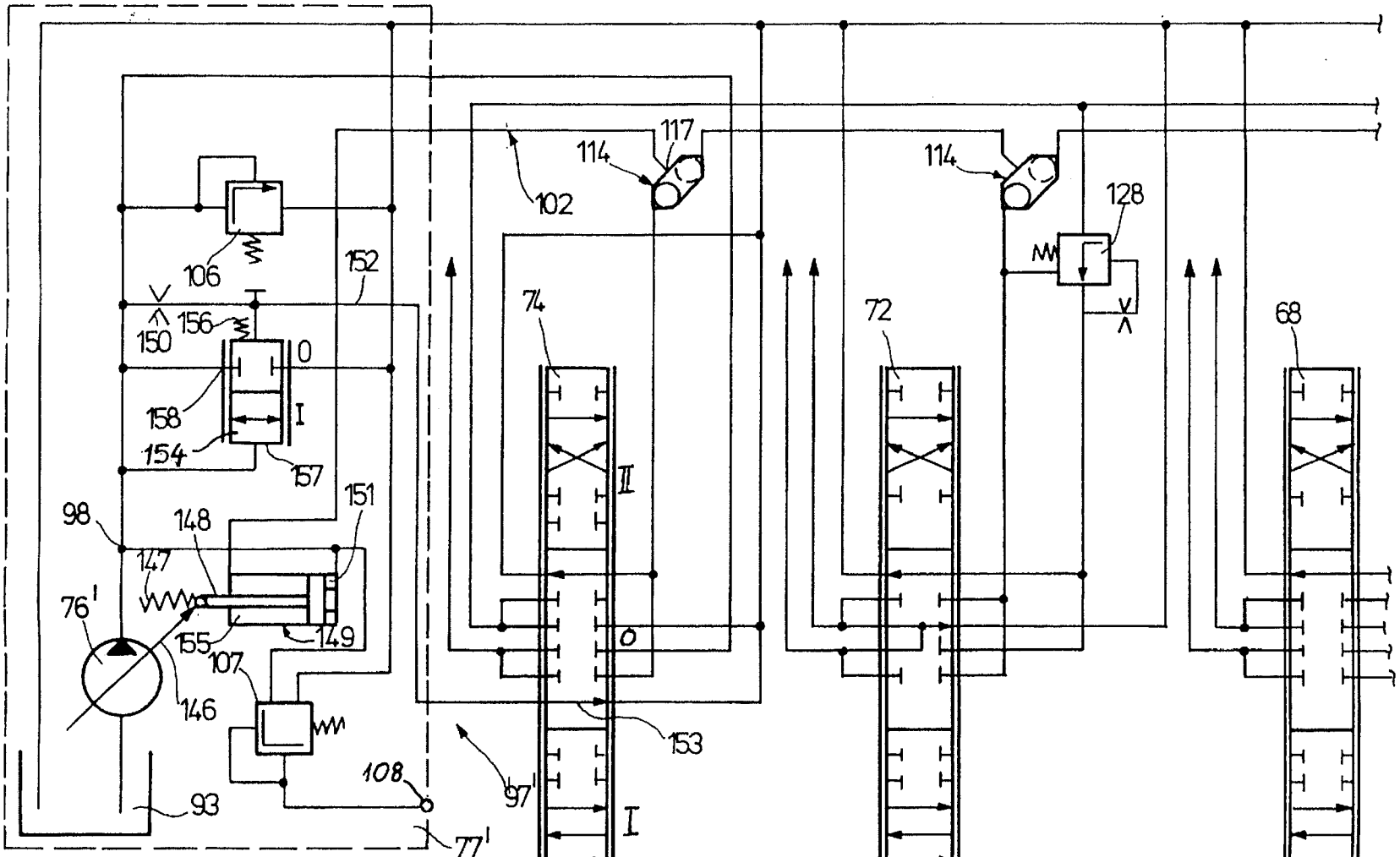
FIG. 4 shows a further embodiment of a pressure supply- and control-device having a variable displacement pump as a pressure source for controlling the movements of the boom.
Figure 5A:
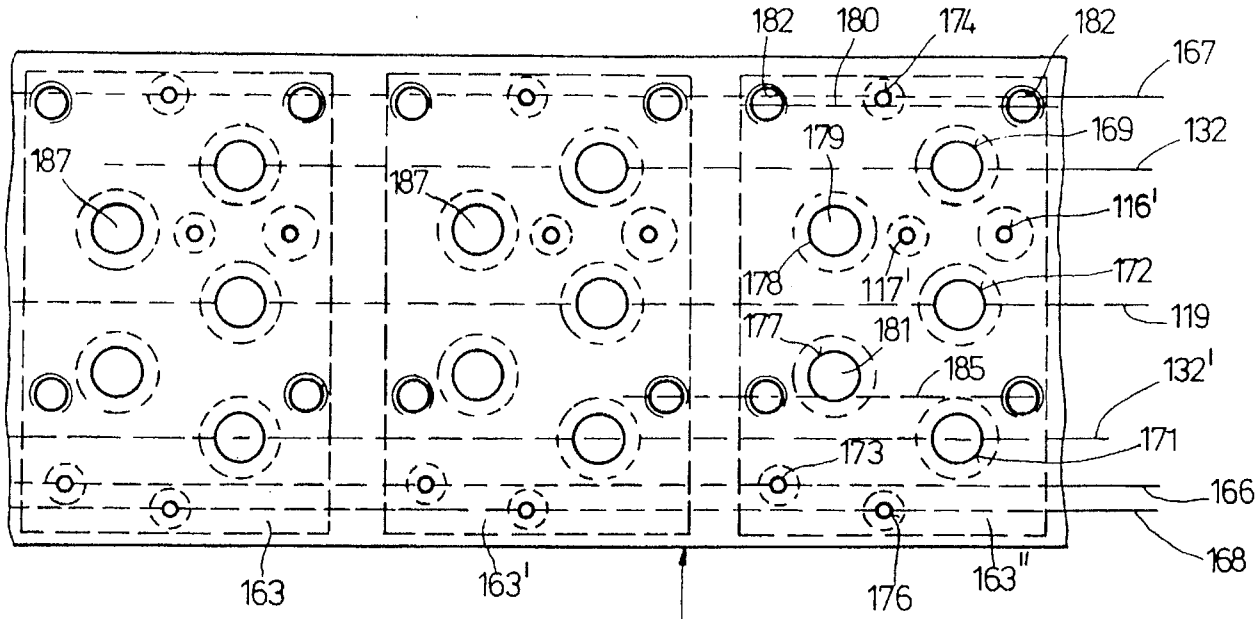
FIG. 5*a* shows the bore hole layout of terminal arrays of a terminal block on which the control valves of the pressure supply- and control-device according to FIGS. 3 and 4 are mountable in hydraulic serial connection.
Figure 5B:
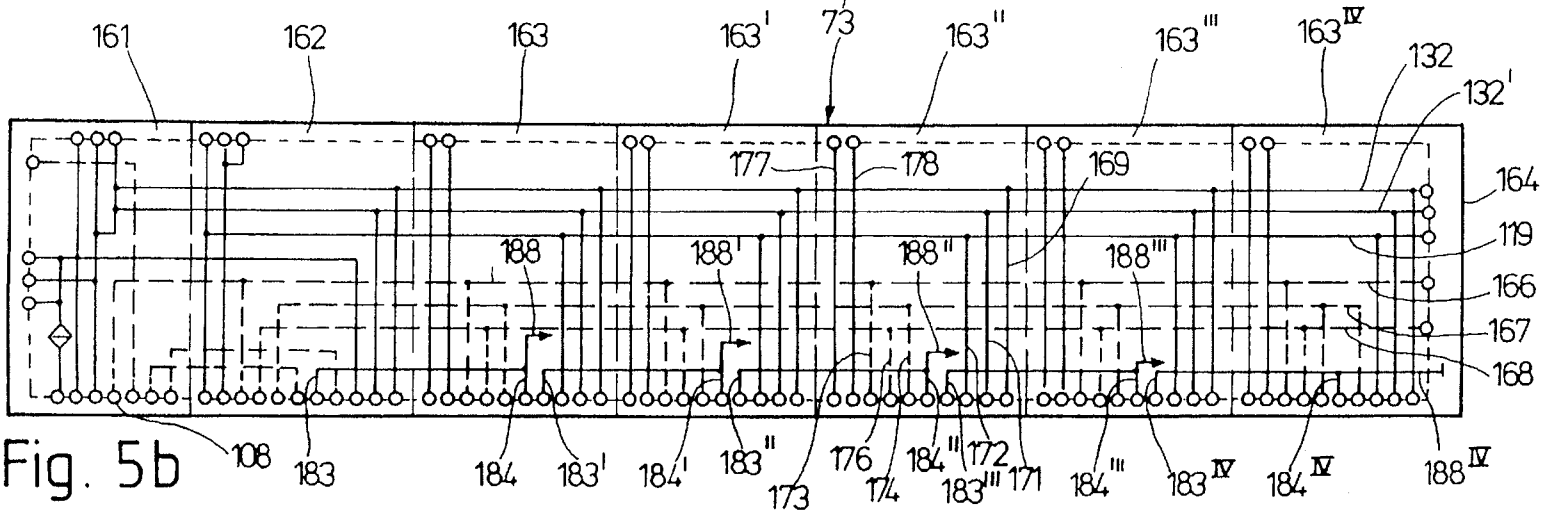
FIG. 5*b* shows the hydraulic circuit diagram of the terminal block according to FIG. 5*a;*
Figure 5C:
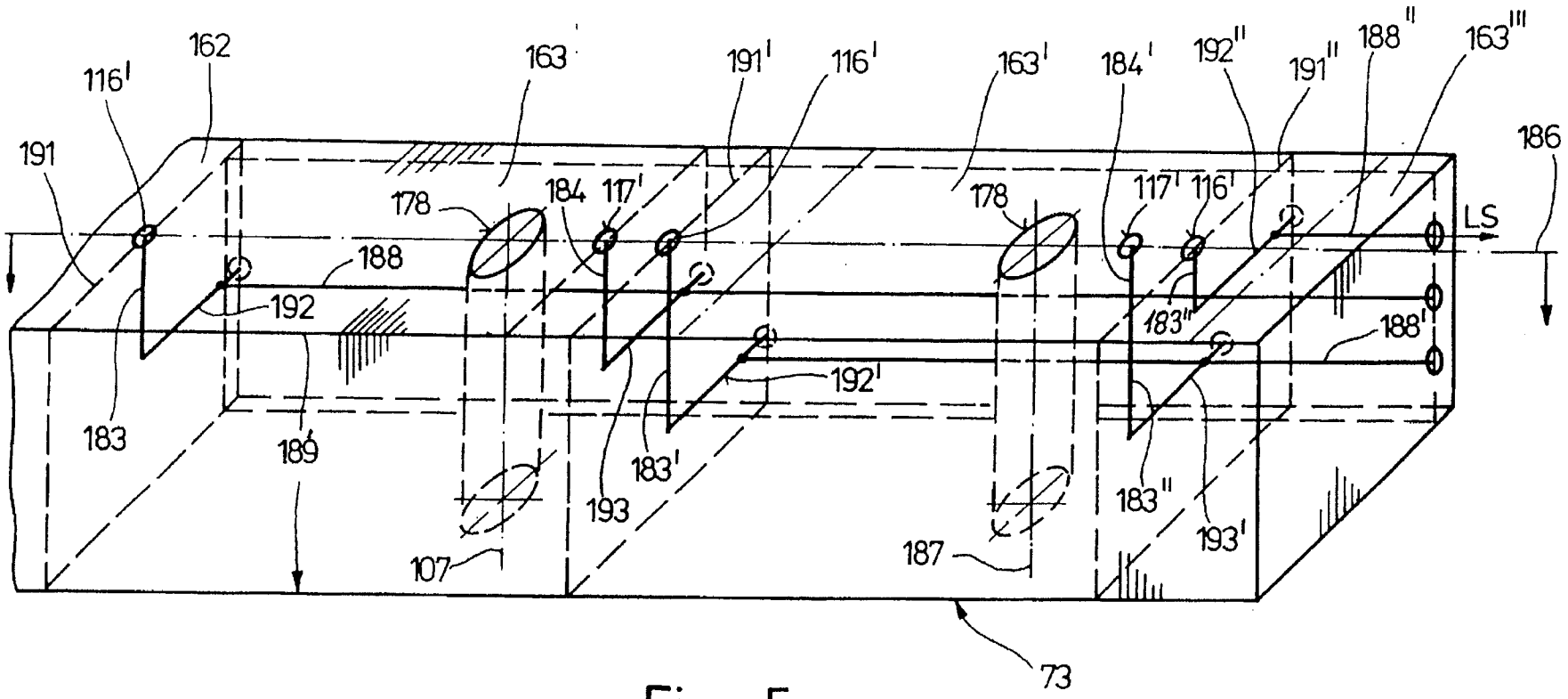
FIG. 5*c* shows details of the design of sections of a load feedback line of the terminal block according to FIGS. 5*a* and 5*b* and FIG. 6 shows a further embodiment of a pressure supply- and control-device for controlling the movements of the boom, in which the control valves are fashioned as "black and white valves".

In order to describe terminal block 73, on which in the case of the embodiment according to FIG. 3 pressure balance 99, in the case of the embodiment according to FIG. 4 2/2-way-valve 154, adjacent to this operating mode selector valve 74, following this control valve 72 for pivot drive 57 of distributing boom 14, and following this control valves 68 to 71, are mounted in this order in hydraulic serial connection, it is now referred to details of FIGS. 5*a*, 5*b* and 5*c*.

Terminal block 73 is designed as a one-piece, elongated-parallel epiped-shaped block of steel or aluminum, on which, viewed in a length-wise direction, are provided a terminal array 161 for functional elements of pressure supply device 77 or 77', a terminal array 162 for mounting operating mode selector valve 74, a terminal array 163 for mounting control valve 72 for pivot drive 57 of distributing boom 14, as well as terminal arrays 163', 163", 163'", and 163$^{IV}$ for elevation control valves 68 to 71, within which these functional elements and valves may be mounted and therefore connected in a pressure tight way to supply and control lines which are executed as deep bores which extend continuously throughout the length of terminal block 73, or which extend over a large amount of the length of terminal block 73.

Longitudinal bores of this type, which are drilled from face 164 which is distanced from terminal array 161 for pressure-supply and -control into terminal block 73, are two return lines 132 and 132' connected to reservoir 93 of pressure supply device 77 or 77', which, in a hydraulic sense, form a single reservoir connection, high pressure supply line 119 which extends to terminal array 162 of operating mode selector valve 74, a control line 166 which extends to terminal array 161 of pressure supply device 77 or 77' and which is connected to control pressure output 108 of pressure reducing valve 107, as well as to bores 167 and 168 which extend to terminal array 162 of operating mode selector valve 74 and are used as control- or leak-lines which in turn are connected to reservoir 93 of pressure supply device 77 or 77', respectively.

Cross-bores 169, 171 and 172 as well as 173, 174, and 176 which end at the connection side of control valves 72 and 68 to 71 for the distributing boom movements within the terminal arrays 163 and 163' to 163$^{IV}$ with an identical bore layout shown in FIG. 5*a* communicate with these lengthwise channels 132, 132', 119 as well as 166, 167, and 168.

Arranged within these terminal arrays 163 and 163' to 163$^{IV}$ are also the valve-sided ports 177 and 178 of terminal bores 179 and 181 traversing terminal block 73 at right angles with respect to the course of the longitudinal bores, the consumer-sided openings of said ports 177 and 178 forming the A- and B-terminal 86 and 87 of the respective control valve.

Threaded bores 182 positioned at the corners of terminal arrays 161 to 163$^{IV}$, which are provided for affixing the valve bodies to the terminal block 73, are fashioned as blind bores which extend only over a small part of the thickness of terminal block 73, so that lengthwise channels, as for instance control line 166, may extend in longitudinal planes 180 and 185 marked by the central axes of the threaded bores.

Within terminal arrays 163 to 163$^{IV}$ corresponding to uniform-standardized-bore layouts, ports 116' of cross bores 183 and 183' to 183$^{IV}$ extending perpendicularly to the plane of the ports of different terminal bores of the terminal block correspond to load-comparative terminals 116 of comparative valve 114, and ports 117' of cross bores 184 and 184' to 184$^{IV}$ correspond to comparative outputs 117 of comparative valves 114. The central axes of cross bores 184 and 184' to 184$^{IV}$ lie in the same longitudinal plane 186 of terminal block 73 as the central axes 187 of the continuous terminal bores 179 which are used as A-terminal channels. A longitudinal bore (FIG. 5*c*) 188 and 188' to 188$^{IV}$ which extends from end face 164 into terminal block 73 is assigned to each of load-comparative terminals 116 of comparative valves 114. Longitudinal bores 188 and 188' to 188$^{IV}$ extend into the plane 191 and 191' to 191$^{IV}$, respectively, of which only planes 191 to 191" are shown in FIG. 5*c*, which lie at right angles with respect to longitudinal edge 189 of terminal block 73, in which the axis of vertical cross bore 183 and 183 to 183$^{IV}$respectively, lies, the port 166' of which forms the comparative input of the respective comparative valve 114. The respective longitudinal bore 188 and 188' to 188$^{IV}$, respectively, is connected by way of a transverse cross bore 192 and 192' to 92$^{IV}$, respectively, which extends from one longitudinal side into terminal block 73, and closed off tightly at that point, to the cross bore 183 and 183 to 183$^{IV}$, respectively, the port 116' of which forms the load comparative terminal of the respective comparative valve 114, and by a further transverse cross bore 193 and 193 to 193$^{IV}$, respectively, to cross bore 184 and 184' to 184$^{IV}$, respectively, the port 117' of which forms the comparative output of the adjacent comparative valve 114 which belongs to the following control valve as seen in the direction of linking, but which is the "preceeding" comparative valve 114 as seen in the direction of feedback.

These longitudinal bores 188 and 188' to 188$^{IV}$, respectively, by way of which in each case only one comparative input 116 of one of comparative valves 114 is connected communicating with comparative output 117 of one adjacent comparative valve 114, are tightly closed by plugs at end face 164 of terminal block 73. In this, comparative input 116' of comparative valve 114 positioned rearward-most from terminal array 161 of pressure supply device 77 or 77', respectively, as seen in the direction of linking, is internally connected to a line leading to reservoir 93 of the pressure supply device.

Cross bores 183 and 184 and 183' to 183$^{IV}$ and 184' to 184$^{IV}$, respectively, which communicate by way of one of longitudinal bores 188 and 188' to 188$^{IV}$, respectively, by way of one of cross bores 192 and 193 or 192' to 192$^{IV}$ and 193' to 193$^{IV}$, respectively, form section 102' of the load feedback line overall designated by reference numeral 102 connecting in each case two control or comparative valves to each other. The first of sections 102', which leads to pressure supply device 77 or 77', respectively, is suitably formed by a bore (not shown) extending from the device side into terminal block 73, in which said bore is connected to comparative output 117 of comparative valve 114 of operating mode selector valve 74.

Terminal block 73, described in detail with reference to FIGS. 5*a* to 5*c*, is also suited for constructing the pressure supply- and control-device 97" shown in FIG. 6 as a further embodiment, which differs from the pressure supply- and control-device 97 shown in FIG. 3 mainly in that control valve 72' for pivot drive 57 of the boom and control valves 68' to 71' for the elevation movements of the boom arms are fashioned as so-called black-and-white-valves, i.e. as valves whose flowpaths have defined flow cross sections in the different functional positions 0, I, and II. In pressure supply- and control-device 97" according to FIG. 6 the terminal block-sided terminal openings 117' and 116' are closed off tightly within terminal arrays 163 and 163' to 163$^{IV}$ respectively, by the respective valve body, since valves functionally corresponding to comparative valves 114 are not needed and pressure balances assigned to movement control valves 68' to 62' are therefore not provided. Within the scope of pressure supply device 77 and the design of operating mode selector valve 74 and its hydraulic connections, pressure supply- and control-device 97" according to FIG. 6 is identical to that of FIG. 3, so that the mention of the corresponding reference numerals in FIG. 6 suffices as a reference to the respective description made with respect to the embodiment according to FIG. 3.

Figure 6:
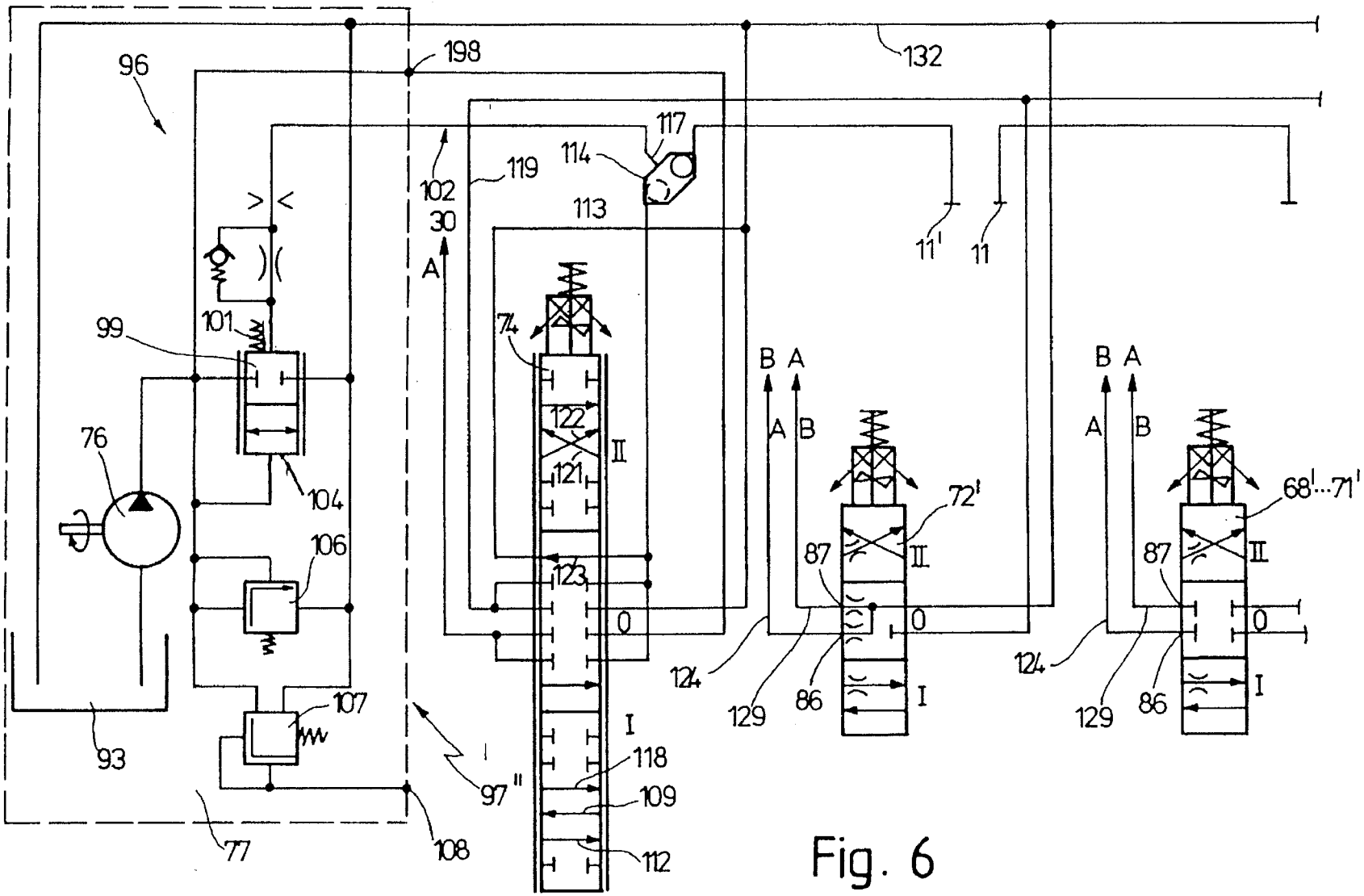

In device 97" according to FIG. 6, comparative input 116 of comparative valve 114 of operating mode selector valve 74 may be connected to reservoir 93 of pressure supply device 77.

The pressure supply- and control-devices described with reference to FIGS. 1 to 6 can also be used with vehicles having a support device 30 and a folding boom 14, in which a device is positioned at the end of boom 14, which must be moveable along a wide area of motion, for instance a cleaning device for planes.

We claim:

1. In a hydraulic pressure supply- and control-device for a mobile concrete pump, comprising a multi-armed distributing boom positioned pivotably on a vehicle and having a hydraulic pivot drive and hydraulic elevation drives individually assigned to arms of the boom, as well as a hydraulic support device by which the vehicle is supported at corners of a larger area outside a vehicle base area against tipping over, as hydraulic consumers for whose pressure supply a single load-sensing pressure supply device is provided, whose pressure output is connectable alternatively to a hydraulic control unit of the support device or a hydraulic control unit of the distributing boom by way of an operating mode selector valve, further comprising electro-hydraulically or electro-pneumatically controlled, hydraulically actuated control valves which are individually assigned to the pivot drive and the elevation drives of the boom, as well as pressure controlled load-comparative valves which react to pressures prevailing in the respective consumers of the boom, which are connected to each other in a hydraulic longitudinal chain and mechanically combined in the form of a terminal block, on which the valve groups formed by said control valve and said comparative valve are positioned spacially adjacent to each other, wherein the comparative valves are connectable in series to each other by channels forming sections of a load feedback line, which lead from a comparative output of the respective comparative valve to a load-comparative terminal of that adjacent comparative valve, which is positioned at a supply device side, and wherein the comparative valves are driven by relatively higher pressure present at a load connection, at which the pressure acting in the connected consumer prevails, than at a load-comparative input of the comparative valves, into a functional position connecting the load connection with the comparative output and blocking it with respect to the load-comparative input, and by relatively higher pressure at the load-comparative input than at the load connection into a functional position connecting the load-comparative input with a load-comparative output and blocking it with respect to the load connection, the improvement wherein said terminal block is a one-piece block made of one of steel and aluminum which is provided as a hydraulic linking element as well as a mechanical carrier of the control valves of the boom control unit, of the operating mode selector valve, and of switching elements of the pressure supply device, in which a) a P-line is connected to all high-pressure terminals of the control valve, b) a reservoir line is connected to all return terminals of the control valves, c) at least one control line is transmitting control pressure for the actuation of the valves, and d) at least one further return line, by which a control circuit of the pressure-actuated valves is completed to a reservoir of the pressure supply device, are designed as single-axis bores extending in a lengthwise direction of the terminal block —the direction of linking—, from which connection channels originate whose valve-sided ports are positioned within terminal arrays of the valves in a bore layout of proportional valves, and that sections of the load feedback line, which are serially connectable to each other by the comparative valves, are formed by individual longitudinal bores introduced into the terminal block from a free end thereof and plugged there, as well as by cross channels connecting these longitudinal bores individually to the load-comparative output of one of the comparative valves as well as to the load-comparative input of the supply-sided adjacent comparative valve.

2. The pressure supply- and control-device of claim 1, wherein the cross channels communicating with each of the plugged longitudinal bores are formed by a first cross bore, which is introduced into the terminal block originating at a longitudinal plane extending perpendicularly with respect to a terminal plane of the valves, penetrates through the longitudinal bore, and is plugged at the longitudinal plane, and by a second cross bore leading to said first cross-bore, being introduced into the terminal block from the connection side, and extending perpendicularly with respect to the terminal plane.

3. A pressure supply- and control-device of claim 1, wherein the load feedback line leading from the comparative valve of the operating mode selector valve to a load sensing input of the pressure supply device is formed by a longitudinal bore introduced into the terminal block originating at the supply side thereof.

4. The pressure supply- and control-device of claim 1, wherein a terminal array for one of a pressure balance and a restrictor arrangement, provided for at least one of a load sensor, a pressure limiting valve and a pressure reducing valve of the pressure supply device, used for the dissipation of control pressure, is also provided on the terminal block.

5. The pressure supply- and control-device of claim 1, wherein the comparative valves are designed as shuttle check valves.

6. The pressure supply- and control-device of claim 1, wherein the comparative input of the comparative valve which is positioned remotely with respect to the pressure supply device is connected with the reservoir of the pressure supply device.

7. The pressure supply- and control-device of claim 1, wherein the control valves for the pivot and elevation drives of the boom are designed as proportional valves, wherein pressure balances individually assigned to the control valves are provided, which control the pressure medium flow through the respective control valve to a constant pressure drop over the respective control valve.

8. The pressure supply- and control-device of claim 7, wherein the pressure balances individually assigned to the control valves are designed as 2-way flow control valves which are hydraulically connected in series with the respective control valve.

9. The pressure supply- and control-device of claim 7, wherein the control valves have additional flowpaths which are open in alternative flow positions and blocked in a neutral position, by way of which the consumer pressure prevails at the comparative input of the respective pressure balance whose reference input is subjected to the output pressure of the pressure supply device as a reference pressure.

10. The pressure supply- and control-device according to claim 1, wherein a pump of the pressure supply device is designed as a controllable pump, having a pressure-controlled flow rate setting element which is supplied with the output pressure of the comparative valve of the operating mode selector valve as control pressure, to which it is subjected in the sense of enlarging the flowrate of the pump.

11. The hydraulic pressure supply- and control-device of claim 10, wherein a double-acting hydraulic linear cylinder is provided as the flow rate setting element of the controllable pump, whose piston, which acts upon the flow rate setting element of the pump, is moveable in the sense of decreasing the flow rate of the pump by subjecting a bottom drive-pressure space of the flow rate setting element to an output pressure of the pump against the action of the output pressure of the comparative valve of the operating mode selector valve introduced into a rod-sided drive pressure space of the cylinder and against a restoring force of a pre-stressed spring, that a 2/2-way valve designed as a pressure controlled proportional valve is connected parallel to the pump, which attains a blocking neutral position by the action of a pre-stressed valve spring and possibly bilateral pressure subjection of a valve piston on a spring-sided face thereof and an opposing face to the output pressure of the pump and a flow position having a flow cross section of the flowpath proportional to the excursion by subjection of only the opposing face of the valve piston opposing the spring side to the output pressure of the pump, and that the pre-stressing of the valve spring is significantly smaller than that of the return spring of the flow rate setting element of the pump and corresponds to approximately half that value.

12. The hydraulic pressure supply- and control-device of claim 11, wherein the spring-sided face of the piston of the 2/2-way proportional valve is suited to be relieved of pressure towards the reservoir of the pressure supply device by way of a flowpath opened only in the neutral position of the operating mode selector valve.

13. The hydraulic pressure supply- and control-device of claim 1, wherein a pump of the pressure supply device is designed to be a fixed displacement pump having a 3-way pressure balance as a load-sensing element.

14. The hydraulic pressure supply- and control-device of claim 13, wherein the control valves for the pivot and elevation control of the boom are designed to be switching valves, which open flowpaths having defined flow cross sections in different functional positions thereof assigned to alternative directions of motion of the respective boom drives.

15. The hydraulic pressure supply- and control-device of claim 14, wherein the ports of the terminal block, by way of which the line sections of the load feedback line open to the terminal side of the terminal block within the terminal arrays of the control valves and terminal-sided ports of the cross bore originating at a control line as well as the cross bores originating at the further return lines open within the terminal arrays, are tightly blocked in a mounted state by way of the valve bodies of the control valves.

16. The hydraulic pressure supply- and control-device of claim 14, wherein the control valves for the elevation drives of the boom are designed as 4/3-way valves having a blocking neutral position, and the control valve for the pivot drive of the boom is designed as a 4/3-way valve which connects both consumer terminals of the pivot drive to the reservoir of the pressure supply device in a neutral position thereof.

17. The hydraulic pressure supply- and control-device according to claim 1, wherein load maintaining circuits positioned at a consumer side are provided, which keep the return lines of the individual consumers of the support device and the boom blocked in the non-actuated state of the operating mode selector valve.

18. The hydraulic pressure supply- and control-device of claim 1, wherein the operating mode selector valve attains a functional position assigned to boom control operation only when a) a preselector control stage is actuated by which the boom is selected as a hydraulic consumer and b) at least one of the control valves of the boom is selected, and remains in a neutral position otherwise.

19. The hydraulic pressure supply- and control-device of claim 18, wherein the operating mode selector valve attains a functional position assigned to the setting operation of the support device by an actuation of the preselector control stage, by which the support device is selected as a hydraulic consumer, and remains there as long as the support device is kept selected as a hydraulic consumer.

20. The hydraulic pressure supply- and control-device of claim 18, wherein the operating mode selector valve attains a functional position assigned to the setting operation of the support device when a) the preselector control stage is actuated selecting the support device as a hydraulic consumer and b) at least one of the control valves of the support device is selected, and remains in a neutral position otherwise.

21. The hydraulic pressure supply- and control-device of claim 18, wherein the preselector control stage is actuated by a first actuation of one control valve of the boom and the support device.

22. The hydraulic pressure supply- and control-device of claim 1, wherein an actuation in the same direction (extension or retraction) of two support cylinders which are arranged at diagonally opposing corners of the support area of the mobile concrete pump is not possible.

23. A pressure supply- and control-device, especially according to claim 1, being positioned on a vehicle having a hydraulic support device and a hydraulically-driven boom, at an end of the boom a work device is arranged moveable over a large range.

* * * * *